United States Patent [19]

Knapp et al.

[11] 3,953,548

[45] Apr. 27, 1976

[54] FUEL INJECTION SYSTEM

[75] Inventors: Heinrich Knapp, Leonberg-Silberberg; Günther Jäggle, Stuttgart, both of Germany

[73] Assignee: Robert Bosch GmbH, Stuttgart, Germany

[22] Filed: Aug. 27, 1974

[21] Appl. No.: 500,926

[30] Foreign Application Priority Data

Sept. 13, 1973 Germany ..... 2346099

[52] U.S. Cl. ..... 261/50 A; 261/116; 261/DIG. 56; 261/DIG. 39; 261/DIG. 78

[51] Int. Cl.[2] ..... F02M 7/22

[58] Field of Search.... 261/50 A, DIG. 56, DIG. 39, 261/116

[56] References Cited

UNITED STATES PATENTS

| | | | |
|---|---|---|---|
| 1,969,638 | 8/1934 | Culp | 261/DIG. 56 |
| 1,998,784 | 4/1935 | Mock | 261/DIG. 39 |
| 2,595,720 | 5/1952 | Snyder | 261/50 A |
| 3,054,603 | 9/1962 | Rodgers | 261/50 A |
| 3,397,843 | 8/1968 | Littlehales et al. | 261/DIG. 39 |
| 3,589,384 | 6/1971 | Eckert | 261/50 A |
| 3,778,038 | 12/1973 | Eversole et al. | 261/50 R |
| 3,791,359 | 2/1974 | Eckert et al. | 261/50 A |

FOREIGN PATENTS OR APPLICATIONS

| | | | |
|---|---|---|---|
| 1,026,783 | 2/1953 | France | 261/50 A |

*Primary Examiner*—Tim R. Miles
*Attorney, Agent, or Firm*—Edwin E. Greigg

[57] ABSTRACT

A fuel injection system for continuous injection of fuel into the induction tube of an internal combustion engine. The induction tube includes adjacent convergent and divergent regions. A throttling element, composed of two conical parts with adjoining bases forms a narrow, annular aperture in cooperation with the diverging region of the induction tube. The throttling element can slide along its axis and its position determines the setting of a control slide within a fuel metering valve assembly which relates the metered out fuel quantity to the air flow through the narrow annular aperture. A bellows mechanism and a lever limit the axial excursion of the throttle element so as to maintain a minimum vacuum in the induction tube. The system also includes a gas-pedal linked cam plate which sets the location of the fulcrum for the limiting lever.

11 Claims, 1 Drawing Figure

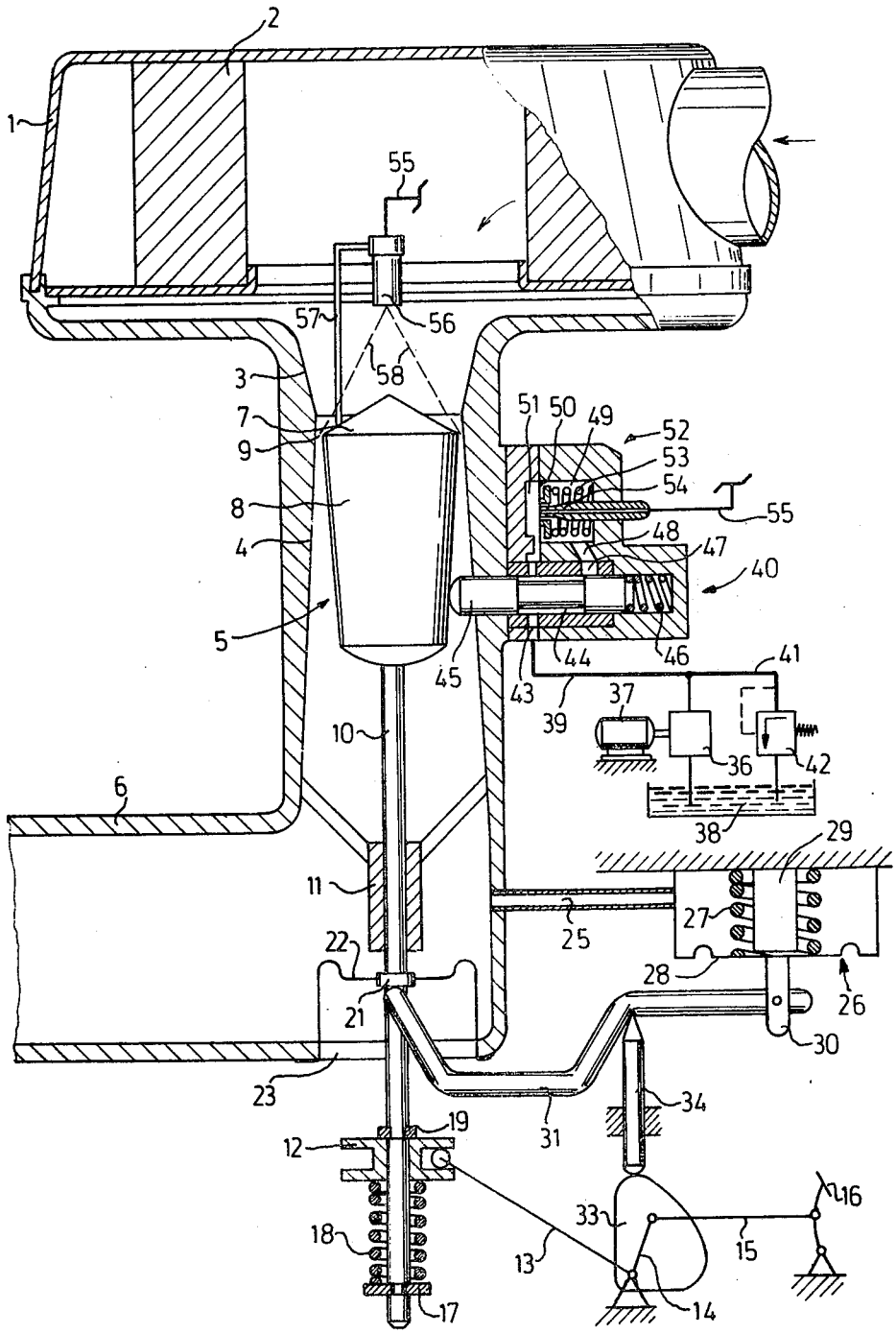
1
2
3
4
5
6
7
8
9
10
11
12
13
14
15
16
17
18
19
21
22
23
25
26
27
28
29
30
31
33
34
36
37
38
39
40
41
42
43
44
45
46
47
48
49
50
51
52
53
54
55
56
57
58

FUEL INJECTION SYSTEM

BACKGROUND OF THE INVENTION

The invention relates to a fuel injection system for mixture compressing, externally ignited internal combustion engines employing continuous fuel injection into the induction tube. The induction tube includes a converging section and, immediately behind it as seen in the direction of air flow, a diverging section. Located in this part of the induction tube is a throttling, element which may be arbitrarily moved in its axial direction and which is composed of substantially two conical portions with the bases of the cones adjacent to each other. The cones have different apex angles and the throttle element cooperates with the diverging section of the induction tube to form a restricted annular air flow passage and, downstream thereof, to form a diffuser having a small divergent angle. Fuel is injected at the narrowest part of the air flow passage. That conical portion of the throttle element which converges in a direction opposite to the air flow direction has a larger apex angle than the other conical portion of the throttle element. The system includes means to equalize the pressures acting on the throttle element.

Fuel injection systems of this type serve the purpose of automatically creating a favorable fuel-air mixture for all operational conditions of the internal combustion engine so as to make possible complete combustion of the fuel and thus to avoid the generation of toxic exhaust gas constituents while maintaining the highest possible performance or the lowest possible fuel consumption. This requires that the fuel quantity be metered out precisely according to the requirements of each operational state of the internal combustion engine.

In engines employing carburetors it is known to achieve adequate fuel vaporization in that the fuel, which is introduced into the aspirated air upstream of the throttle valve, experiences the sonic velocity prevailing at the throttle valve. Behind the throttle valve, however, two separate streams of fuel-air mixtures having differing concentrations are formed and this leads to an asymmetric distribution of the fuel within the mixture. When the engine is accelerated or when it is operating under load, this mixture is even less favorable because the air passing the throttle valve does not reach sonic velocity, thus permitting unvaporized fuel to reach the engine cylinders. Such mixtures result in high concentrations of uncombusted hydrocarbons and the presence of carbon monoxide and nitrogen oxides in the exhaust gas.

In known fuel injection systems it is therefore proposed to provide a throttling element in a venturi-like region of the induction tube so constructed that sonic velocity always prevails at the minimum cross section formed by the throttling element and the venturi-like member of the induction tube, thus permitting an optimized preparation of the fuel for combustion. The need to prevent the presence of toxic components in the exhaust gas of the internal combustion engine makes it necessary to maintain, if possible, a stoichiometric fuel-air ratio by regulation.

OBJECT AND SUMMARY OF THE INVENTION

It is an object of the invention to provide a fuel injection system of the known knid which meets the above demands made on such a fuel injection system and does so at the lowest possible constructional expense.

This object is attained, according to the invention, in that the fuel injection system includes a metering valve which can be actuated in dependence on the size of the minimum annular flow cross section and which meters out a fuel quantity in linear dependence on the air quantity flowing through the induction tube.

It is an advantageous characteristic of the invention that the throttling element serves as the actuating element for the metering valve and also that the metering valve includes a control slide which glides along that conical portion of the throttling element which points in the direction of air flow. The control slide moves axially in dependence of the position of the throttling element and it has an annular groove which cooperates with control slits to form a fuel aperture of variable cross section. A constant pressure difference can be maintained across this variable metering valve aperture by means of a differential pressure valve embodied as a flat-seat valve including a fixed valve seat and a diaphragm.

It is a further advantageous feature of the invention that the injection nozzle is fixedly attached to the throttle element and is located upstream of the throttle element in such a manner that the cone of injected fuel is always directed into the narrowest part of the annular flow passage.

It is another advantageous characteristic of the invention that the throttle element is guided by a rod slidably mounted in a bearing block and is connected with a diaphragm for the purpose of equalizing the pressures acting on the throttle element. One side of the diaphragm experiences atmospheric pressure and the other side experiences the reduced pressure or "vacuum" prevailing in the induction tube downstream of the throttle element. The surface area of the diaphragm is made approximately equal to the maximum circular cross section of the throttle element.

It is a still further advantageous feature of the invention that the slidable rod carries a sliding bushing which is pressed against a stop by a spring and that the bushing is engaged by the gas pedal linkage. In order to maintain a minimum value of vacuum in the induction tube downstream of the throttle element, the position of the throttle element within the induction tube can be fixed. This is accomplished by a diaphragm box or bellows. The interior surface of the diaphragm is exposed to the induction tube vacuum and is also biased by the force of a spring, and the exterior surface may be exposed to atmospheric pressure and can engage a lever connected to the rod guiding the throttle element. The diaphragm moves up to a stop when the pressure in the induction tube is below a predetermined minimum value. Another preferred characteristic of the invention is that the location of the fulcrum of the lever can be changed by a movable bolt which follows a cam plate in dependence on the position of the gas pedal.

Still another preferred characteristic of the invention provides that the fuel injection system is disposed in the immediate vicinity of the air filter of the engine.

BRIEF DESCRIPTION OF THE DRAWING

The single FIGURE of the drawing is a cross-sectional representation of the fuel injection control system according to the invention.

DESCRIPTION OF THE PREFERRED EMBODIMENT

In the exemplary embodiment shown in the FIGURE, combustion air flows in the direction of the arrow through an air filter 2 located in the housing 1. It then flows through a converging section 3 of the induction tube, a diverging section 4 of the induction tube which contains a throttle element 5 and finally through a section 6 of the induction tube to one or several cylinders (not shown) of an internal combustion engine. The throttle element 5 includes two conical parts 7 and 8 with adjacent bases and different apex angles, where the conical part 7, which points upstream, has a greater apex angle than the conical part 8 pointing or converging in the stream direction. The throttle element 5 and the diverging section 4 of the induction tube cooperate to form an annular flow passage which is most restricted, or narrowest at the level of the plane where the two conical parts 7 and 8 adjoin. At this location, the flow passage has its minimum flow cross section 9. The conical part 8 of the throttle element cooperates with the same section 4 of the induction tube to form a diffuser having a small angle of opening or divergence.

The throttle element is guided by a rod 10 slidably mounted in a bearing block 11 and carrying a bushing 12 which is engaged by the gas pedal linkage 13, 14 and 15 so that the throttle element may be moved by the gas pedal 16. The bushing 12 is pressed against a stop 19 on rod 10 by a spring 18 supported on a ring 17.

Another ring 21 connects a diaphragm 22 to the rod 10. One side of the diaphragm is exposed to the induction tube pressure prevailing downstream of the throttle element 5 and the other side is exposed to atmospheric pressure admitted through an opening 23. The surface area of the diaphragm is so chosen that it approximates the circular cross section of the throttle element. Thus, the force acting on the throttle element due to the pressure drop at the throttle element 5 within the induction tube is opposed by an equal counterforce.

In order to make it possible to maintain a minimum vacuum within the induction tube downstream of the throttle element, the induction tube vacuum is imparted through a line 25 to a diaphragm box or bellows 26. The interior surface of the diaphragm 28 is exposed to the induction tube vacuum and the force of a spring 27 and its other side is exposed to atmospheric pressure. If the manifold pressure falls below a certain predetermined minimum vacuum, then the diaphragm 28 moves up to a stop 29. The motion of the diaphragm 28 is transmitted by an intermediate link 30 to a lever 31 and when the vacuum is insufficient, for example, when the vehicle is climbing and the gas pedal is fully depressed, the lever 31 holds the throttle element in such a position that the flow of gases through the minimum flow cross section 9 occurs at the speed of sound. For this purpose, the diaphragm box 26 holds the lever 31 so that the ring 21 of the diaphragm 22 rests on the lever 31. Thus, the gas pedal can no longer displace the throttle element 5 in the direction in which the minimum flow cross section 9 would increase. Instead, the gas pedal 16 moves the bushing 12 against the force of spring 18 without changing the position of rod 10.

The gas pedal linkage 15, 14 simultaneously rotates a cam plate 33 whose circumference is followed by a bolt 34 serving as the slidable fulcrum of lever 31. The presence of this sliding fulcrum of lever 31 makes it possible to account for both load and rpm when maintaining the minimum vacuum within the induction tube.

A fuel pump 36, driven by an electric motor 37, pumps fuel from a fuel container 38 and delivers it through a line 39 to the fuel metering valve assembly 40. Branching off from line 39 is a return line 41 containing a pressure limiting valve 42. From line 39, fuel flows through a channel 43 within the housing of the fuel metering valve assembly 40 and hence into an annular groove 44 in a control slide 45. One end of the control slide 45 is urged against the surface of the conical part 8 of the throttle element 5 by a spring 46 which serves as a resetting force. Thus, the longitudinal motion of the throttle element 5 results in the axial displacement of the control slide which causes the annular groove 44 to overlap a control slit 47 to a greater or lesser extent. The metered-out fuel flows through a channel 48 into a chamber 49 which is separated by a diaphragm 50 from another chamber 51. The two chambers and the diaphragm 50 together form a differential pressure valve 52 since the chamber 51 communicates, through channel 43, with the annular groove 44 in the control slide 45. The differential pressure valve is biased in the opening direction by a spring 53. From chamber 49, fuel flows over the fixed valve seat 54 and a line 55 to the injection nozzle 56 which is rigidly connected to the throttle element 5 by a guide element 57 and is so disposed upstream of the throttle element 5 that the cone of injected fuel 58, which is shown in broken lines, is always directed toward the minimum air flow cross section 9.

The fuel injection system according to the invention offers the advantage that the fuel metering valve 40 meters out a quantity of fuel which is a linear function of the minimum flow cross section, while the aspirated air quantity also has a linear relationship to the minimum flow cross section 9. The purpose of the differential pressure valve 52 is to maintain a constant pressure difference at the metering valve assembly 40 so that, regardless of the quantity of fuel injected by the injection nozzle 56, the path traveled by the control slide 45 is proportional to the metered out fuel quantity. In order to avoid wetting the inside walls of the induction tube, the injection nozzle 56 is so disposed upstream of the throttle element that the cone of injected fuel 58 is always aimed at the minimum cross section 9 where air flows at the speed of sound. This results in an optimum preparation of the fuel-air mixture. The conical part 8 of throttle element 5 and the diverging section 4 of the induction tube together form a diffuser with a small opening angle so as to keep the pressure loss and, hence, the power loss as low as possible. The sudden enlargement of the cross section of the diffuser at the end of the throttle element 5 results in a further shearing effect on any drops of fuel which may still be present within the fuel-air mixture. Thus, the fuel-air mixture is admitted to the engine cylinders without any thermal treatment with the added advantage that additional heat energy is withdrawn from the motor cylinders for vaporizing the droplets of fuel, thus lowering the combustion temperatures and reducing the formation of nitrogen oxides.

In order to ensure that, even under extreme operational conditions, the gases flowing through the minimum flow cross section 9 flow at the speed of sound, the longitudinal sliding motion of the throttle element is limited by the lever 31 after the induction tube vacuum actuates the diaphragm box 26 and the position of the gas pedal 16 defines an associated position of bolt 34 via the cam plate 33.

Whenever the vacuum within the induction tube reaches a minimum value and the flexible diaphragm 8 of the diaphragm box moves up to the stop 29, the lever 31 lightly touches the ring 21 on rod 10. This condition is always maintained in that the fulcrum of lever 31 can move in dependence on the position of the gas pedal due to the presence and cooperation of the cam plate 33 and the bolt 34.

The greatest diameter of the throttle element 5 approximately corresponds to the inside diameters of the converging section 3 and of the downwardly diverging section 4 of the induction tube at their plane of contact. If sonic velocity prevails within the minimum flow cross section 9, then the air quantity is proportional to the minimum flow cross section 9 and it is also proportional to the axial position of the throttle element 5 within the induction tube 4, so that the fuel metering valve assembly 40, when disposed according to the invention, meters out a fuel quantity which is proportional to the air quantity flowing through the induction tube.

While a specific embodiment of an improved fuel injection system has been described, it is to be understood that numerous variants and other embodiments are possible within the spirit and scope of the invention, the scope being defined by the appended claims.

What is claimed is:

1. In a fuel injection system for mixture compressing, externally ignited internal combustion engines employing continuous fuel injection into the induction tube of the engine, the induction tube including in series and immediately adjacent, a converging region and a diverging region, the diverging region containing an axially slidable throttle element composed in part of two coaxial conical parts with adjoining bases and different apex angles, the slidable throttle element and the diverging region of the induction tube being positioned to form a minimum annular flow cross section and, downstream thereof, to form a shallow-angled diffuser, and wherein the fuel is injected into the minimum flow cross section, wherein that conical part of the throttle element which converges in the upstream direction has a larger apex angle than the other conical part and wherein the pressures acting on the throttle element are equalized, the improvement comprising:

a. a fuel metering valve assembly means located in the fuel injection system for metering fuel in dependence on the size of said minimum flow cross section and in substantially linear dependence on air flow quantity, including a control slide which touches that conical part of said throttle element which converges in the direction of air flow and is slidable in its axial direction depending on the position of said throttle element.

2. A fuel injection system as defined in claim 1, wherein said control slide is provided with an annular groove, and said fuel metering valve assembly further includes a control slit, said annular groove variably overlapping said control slit, and further including a differential pressure valve which maintains a constant pressure difference across said control slit.

3. A fuel injection system as defined in claim 1, further including a fuel injection nozzle rigidly coupled to said throttle element and disposed upstream thereof for directing a cone of injected fuel to said minimum flow cross section.

4. A fuel injection system as defined in claim 3, further including a bearing block and a rod gliding therein, said rod being attached to said throttle element for the longitudinal guidance thereof.

5. A fuel injection system as defined in claim 4, further including a diaphragm whose surface area is approximately the same as the cross section of said throttle element and which is attached to said rod, one side of said diaphragm being exposed to induction tube pressure and the other side of said diaphragm being exposed to atmospheric pressure, and where said diaphragm serves to equalize the pressures acting on said throttle element.

6. A fuel injection system as defined in claim 4, further including a bushing, mounted on said rod; a spring, also mounted on said rod; and a stop, also mounted on said rod; said bushing being pressed against said stop by said spring to permit external actuation of said rod.

7. A fuel injection system as defined in claim 6, including gas pedal linkage of the engine, said bushing being engaged by said gas pedal linkage.

8. A fuel injection system as defined in claim 7, further including means for fixing the axial position of said throttle element thereby maintaining the pressure in said induction tube below a predetermined value.

9. A fuel injection system as defined in claim 8, wherein said means for fixing the position includes a bellows, connected to said induction tube and having a diaphragm; and a lever, engaging said bellows and said rod, the pressure in said induction tube being transmitted to said bellows whose motions are transmitted via said lever to said rod, thereby fixing the position of said throttle element.

10. A fuel injection system as defined in claim 9, wherein said bellows includes a stop against which said diaphragm of said bellows attaches when the pressure in said induction tube falls below a predetermined value.

11. A fuel injection system as defined in claim 9, further including a slidable bolt and a cam plate; said cam plate being rotatable by said gas pedal linkage of the internal combustion engine and said bolt following the circumference of said cam plate for changing the location of the fulcrum of said lever.

* * * * *